US006666274B2

(12) United States Patent
Hughes

(10) Patent No.: US 6,666,274 B2
(45) Date of Patent: Dec. 23, 2003

(54) TUBING CONTAINING ELECTRICAL WIRING INSERT

(75) Inventor: William James Hughes, Tulsa, OK (US)

(73) Assignee: Sunstone Corporation, Oklahoma City, OK (US)

( * ) Notice: Subject to any disclaimer, the term of this patent is extended or adjusted under 35 U.S.C. 154(b) by 0 days.

(21) Appl. No.: 10/146,288

(22) Filed: May 15, 2002

(65) Prior Publication Data

US 2003/0213598 A1 Nov. 20, 2003

(51) Int. Cl.[7] ..... E21B 17/18
(52) U.S. Cl. ..... 166/385; 166/242.6; 166/65.1
(58) Field of Search ..... 166/57, 77.2, 77.3, 166/77.4, 384, 380, 385, 241.6, 241.7, 242.6

(56) References Cited

U.S. PATENT DOCUMENTS

| | | | | | |
|---|---|---|---|---|---|
| 4,001,774 | A | * | 1/1977 | Dawson et al. | 340/854.6 |
| 4,095,865 | A | | 6/1978 | Denison | 339/16 R |
| 4,683,944 | A | | 8/1987 | Curlett | 166/65.1 |
| 4,788,544 | A | | 11/1988 | Howard | 340/853 |
| 4,799,544 | A | | 1/1989 | Curlett | 166/65.1 |
| 4,836,305 | A | * | 6/1989 | Curlett | 175/215 |
| 4,914,433 | A | | 4/1990 | Galle | 380/854 |
| 5,563,512 | A | * | 10/1996 | Mumby | 324/339 |
| 5,950,744 | A | | 9/1999 | Hughes | 175/320 |
| 6,003,606 | A | * | 12/1999 | Moore et al. | 166/381 |
| 6,015,015 | A | * | 1/2000 | Luft et al. | 166/384 |

* cited by examiner

*Primary Examiner*—Frank Tsay
(74) *Attorney, Agent, or Firm*—Rudolf O. Siegesmund

(57) ABSTRACT

The invention comprises a section of improved tubing with coupled end connectors and an insert containing at least one electrical wire. The insert has an outside diameter that is approximately equal to the inside diameter of the improved tubing. The insert also has projections at each end such that when two inserts are placed end to end, the projections will mate up. The insert has at least one groove cut into its side and running the length of the insert. The groove is for the placement of a wire for transmission of power to the well bore or for the placement of a wire for transmission of data from the well bore. When a plurality of the inventions are placed end to end, the insert projections line up the electrical connectors and correct mating of the insert projections will result in correct mating of the electrical connectors.

49 Claims, 7 Drawing Sheets

TUBING CONTAINING ELECTRICAL WIRING INSERT

FIELD OF THE INVENTION

The present invention generally relates to tubing that is used to produce hydrocarbons in a subterranean environment and specifically to an improved tubing having an insert with electrical wiring.

BACKGROUND OF THE INVENTION

Basic artificial lift methods to produce oil and water from a well have improved and changed in recent years. Nearly all methods of artificial lift still employ the connection of a plurality of pipes to form a conduit within a well that has been drilled and cased to allow oil and water to be pumped from the bottom of the well to production tanks at the surface. The production string usually has a pumping device at its lower end that is positioned near the bottom of the well bore that has been prepared for production. Pumping mechanisms such as electrical submersible pumps (ESP) and progressive cavity pumps (PCP) provide the energy needed to bring fluids to the surface through a string of jointed tubing. These pumps normally require an electric motor in order to make them work. Although a multitude of improvements have been made to these pumps over the years, there has been little done to reposition the wires that provide power to the pump from the outside of the tubing to the inside of the tubing.

For various reasons, those who are skilled in the science of producing fluids from a well have sought out a reliable method of supplying power to the bottom of a well bore. The previously proposed solutions to this problem have been unreliable, expensive, and complicated to install and remove. For example, the currently preferred method of power transmission to the bottom of the well bore is to secure a cable, that contains one or more wires by means of bands that secure the cable to the outside of the production string of tubing. The bands keep the wire adjacent to the tubing so that it does not snag on the production casing or on any objects which might be in the well bore. The bands also support the weight of the cable by securing the cable to the tubing. However, this method is problematic because it exposes the cable and bands to the corrosive elements of the well bore. Furthermore, installing (running) or removing (pulling) the tubing string creates opportunities to separate the cable from the tubing because inclined well bores (the most common type of well bores) increase the chance of the band to hanging up and failing at the gap where two joints of casing have been screwed together. Failure of one or more bands can prevent the removal of the pump or tubing because the annular space between the outside of the production tubing and the inside of the production casing is small and the cable, if not secured to the tubing, can wedge between the casing and the tubing causing the tubing to become stuck. Even if the cable does not break, the insulation on the wire inside the cable can be damaged which can create a short circuit in the electrical circuit, rendering the wire essentially useless. The tubing string then has to be pulled back up to the surface, and the short found and repaired, before the pump can be run back to bottom of the well bore. The problems created by banded external cables are costly and time consuming. Therefore, a need exists for an alternative method of power transmission from the surface to the bottom of the well bore that is both reliable and cost effective.

One solution to the above stated problem is to employ a plurality of tubing with multiple wires attached to the inside of the tubing instead of the outside of the drill pipe. While this solution alleviates the problem of snagging the wire, it does not solve the problem of exposing the wire to the harsh environment of the produced fluids that are contained within the production tubing. Simply hanging the cable on the inside of the tubing is also problematic because there is no way to support the weight of the cable and the pressure requirements of the pump will be higher due to the added friction between the fluid that is being pumped and the rough exterior of the cable.

Another solution to the above stated problem is to concentrically position the wires on the exterior of a tube that is inserted and attached to the actual production tubing itself. This solution avoids the problems presented by simply attaching the wire to either the interior or the exterior of the tubing. An example of this technique can be found in U.S. Pat. No. 4,683,944 (the '944 patent) entitled "Drill Pipes and Casings Utilizing Multi-Conduit Tubulars." The '944 patent discloses a drill pipe with electrical wires positioned inside conduits in the drill pipe wall. However, positioning the wire inside the drill pipe wall significantly decreases the overall pipe wall thickness. In order to overcome the decreased wall thickness, significantly thicker drill pipes will have to be used. Furthermore, the multiple conduits create weak points in the drill pipe in between the conduits. The high rotational stress which the drill pipe encounters in the drilling operations can cause stress fractures in the pipe wall between the multiple conduit tubulars. In an extreme case, high rotational stress can lead to an internal fracture in the drill pipe that disengages the interior wall of the drill pipe from the exterior wall of the drill pipe.

Furthermore, the manufacture of the multiple conduit drill pipe is a complicated process which is unlike the manufacturing process for conventional drill pipe. Conventional drill pipe is manufactured by attaching male and female pipe connections to opposite ends of a conventional piece of pipe. The two connections are usually welded to the pipe. Multiple conduit pipes must be either extruded with the multiple conduits in place, or the multiple conduits must be drilled or cut out of a conventional drill pipe. In either case, the costs associated with manufacture of multiple conduit drill pipe are high.

Another problem encountered in the addition of wires to drill pipe, which is not unique to multiple conduits, is the problem associated with creating reliable, secure electrical connections. In conventional drill pipe the individual pipe segments screw together, creating a problem for connecting the wires during the screwing or unscrewing process. This problem can be overcome by using drill pipe that plugs together and that is secured with a threaded coupler. This type of connection is known in the art. The '944 patent discloses a similar type of coupling connection, but requires a planer conduit seal in between the individual pipe segments in order to assure the integrity of the conduit connection. The removable conduit seal is crucial to the method in the '944 patent because a permanently installed conduit seal would be susceptible to damage during manufacture, transportation, storage, and installation of the multiple conduit drill pipe during drilling operations. Installing these conduit seals during the drilling process is also a cumbersome and a time consuming process. Therefore, a need exists for a method of transmitting electrical power to the bottom of a well bore in which the electrical connections are adequately protected from damage and the process of connecting the individual pipe segments is relatively simple and fast.

The needs identified above exist for production tubing, drill pipe, casing, and/or for any cylindrical pipe used to produce hydrocarbons in a subterranean environment. Therefore, as used herein, the term "tubing" shall mean production tubing, drill pipe, casing, and/or any other cylindrical pipe that is used to produce hydrocarbons in a subterranean environment.

Since, the previous solutions to the power transmission problem are lacking, a need still exists for an apparatus and method of transmitting power to a well bore in which the wire is not exposed to either the interior or the exterior of the tubing and is operable with any conventional tubing, including without limitation production, casing or drill pipe. Furthermore, a need exists for an apparatus and method for connecting the individual tubing segments together in which the electrical connections are well protected and the connection process is quick and easy.

SUMMARY OF THE INVENTION

The present invention, which meets the needs stated above, is an improved tubing which overcomes the problems presented by earlier inventions involving tubing and electrical wiring combinations. The invention comprises a section of tubing with coupled end connectors and an insert containing at least one electrical wire. The insert has an outside diameter that is approximately equal to the inside diameter of the improved tubing. The insert also has projections at each end such that when two inserts are placed end to end, the projections will mate up. The insert has at least one groove cut into its side and running the length of the insert. The groove is for the placement of a wire for transmission of power to the well bore or for the placement of a wire for transmission of data from the well bore. The groove is installed down the length of the insert. The groove is deep enough so that when a wire is placed inside the groove, the wire does not project beyond the outside diameter of the insert. The insert may contain as many groove and wire combinations as are necessary for the particular application. The wire has an electrical connection at each end of the insert. When the inserts are placed end to end, the insert projections line up the electrical connectors and correct mating of the insert projections will result in correct mating of the electrical connectors.

The inserts, are the same length as the tubing and are installed inside the tubing such that the insert is flush with the first end of the tubing. The inserts are then welded to the tubing or secured to the tubing by some other method. A threaded coupler is then installed on the second end of the tubing to protect the exposed insert and electrical connector. The coupler will also be used to secure the improved tubing together.

Individual pieces of improved tubing are connected together in a three step process. First the coupler is threaded onto the second end of the tubing. Next, the first end of one tubing member is positioned above the second end of another tubing member. Next, the insert projections are properly aligned so that they will mate together. Then, the two pieces of tubing are plugged together so that the electrical connections engage each other. Finally, the coupler is screwed onto the first end of the tubing so that the two pieces of tubing are secured together. The process may be repeated as necessary to create an elongated string of improved tubing.

DETAILED DESCRIPTION OF THE PREFERRED EMBODIMENT

Figures 1, 2, 3:
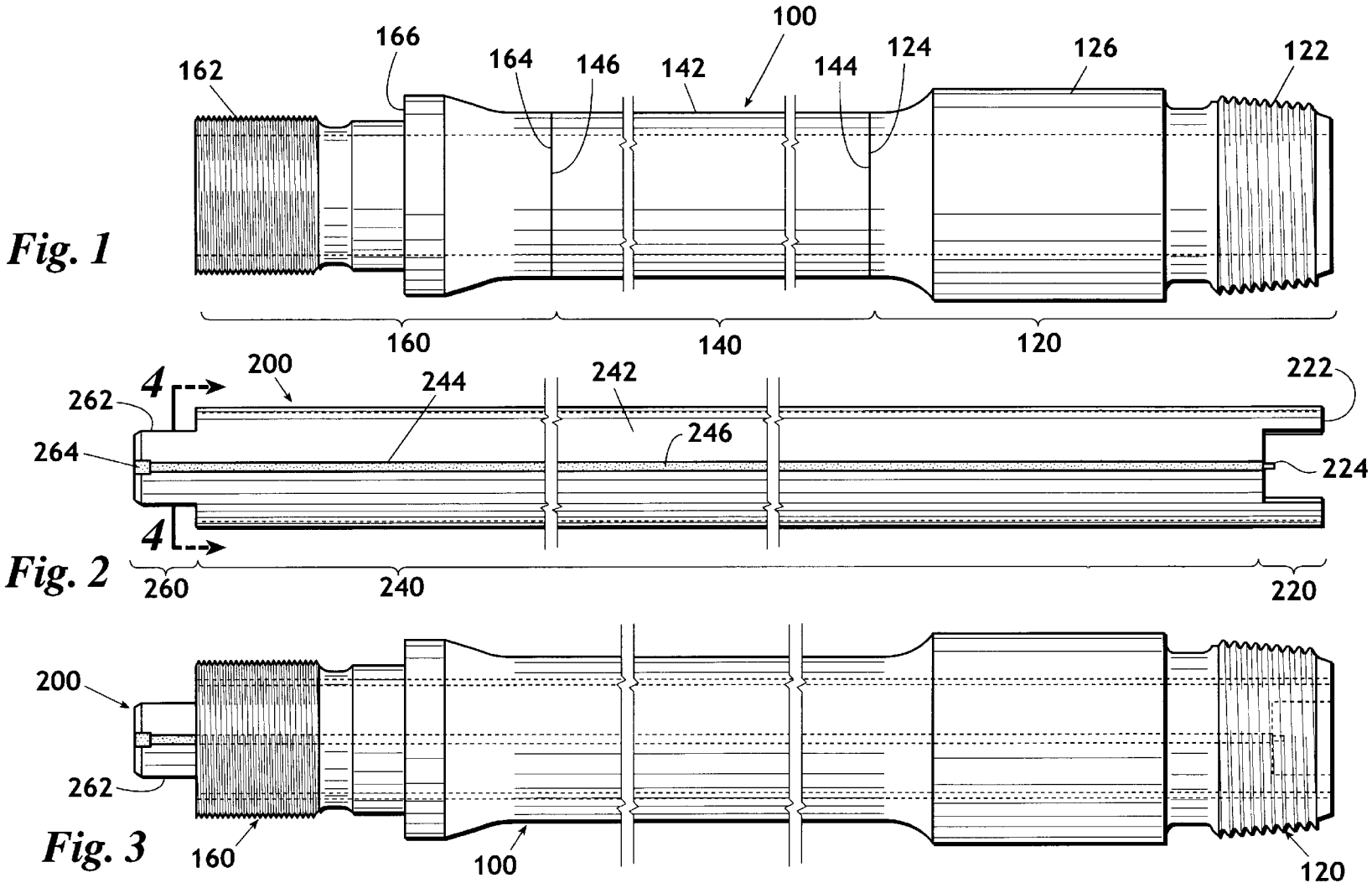
FIG. 1 is an illustration of the improved tubing without the insert or the coupler.
FIG. 2 is an illustration of the insert.
FIG. 3 is an illustration of the insert installed in the improved tubing.

As used herein, the term "improved tubing" means tubing that is adapted to receive a coupler and that has an insert. FIG. 1 is an illustration of improved tubing 100 without insert 200 (see FIG. 2) or coupler 300 (see FIG. 5). Improved tubing 100 is comprised, of three sections: first end 120, midsection 140, and second end 160. First end 120 comprises coarse threads 122, first end weld joint 124, and wrench grip 126. Midsection 140 comprises pipe 142, pipe first end 144, and pipe second end 146. Second end 160 comprises fine threads 162, second end weld joint 164, and coupler stop flange 166. First end 120 and second end 160 may be like those found in U.S. Pat. No. 5,950,744 (the '744 patent) entitled "Method and Apparatus for Aligning Pipe and Tubing." Typically, first end 120 and second end. 160 are manufactured by either casting or forging and pipe 142 is manufactured by some other method (i.e. electric resistance welding or extrusion). The manufacture of improved tubing 100 involves the threading of first end 120 and second end 160 to pipe 142. While the preferred method of manufacturing first end 120 and second end 160 is threading the two ends of improved tubing 100, those skilled in the art will be aware of other methods of manufacturing first end 120 and second end 160. Regardless of the method of manufacture, the inside diameter of first end 120, midsection 140, and second end 160 are substantially the same so that when insert 200 engages improved tubing 100, the outside surface area of insert 200 contacts the inside surface area of improved tubing 100.

FIG. 2 is an illustration of insert 200. Insert 200 is comprised of insert first end 220, insert midsection 240, and insert second end 260. Insert first end 220 comprises insert first end projection 222 and insert first end electrical connection 224. Insert midsection 240 comprises insert body 242 and insert groove 244. Insert second end 260 comprises insert second end projection 262 and insert second end electrical connection 264. The depressions in insert second nd 260 in between insert second end projections 262 match up with the insert first end projections 222. Likewise, the depressions in insert first end 220 in between insert first end projections 222 match up with the insert second end projections 262. Thus, when two inserts 200 are coaxially aligned with insert first end 220 facing insert second end 260, insert first end 220 will mate up with insert second end 260. Insert 200 also contains insert groove 244 which is a groove cut down the long axis of insert 200. Insert groove 244 is sufficiently large to accommodate at least one wire 246. Wire 246 is electrically coupled to insert first end electrical connection 224 and insert second end electrical connection 264 and is used as a medium to transfer electricity from the surface to the bottom of the well bore. Insert first end electrical connection 224 and insert first end electrical connection 264 are single plug connectors similar to the K-25 series electrical connectors produced by Kemlon Products and Development Co. of Pearland, Tex. The K-25 series of single plug electrical connections are able to withstand temperatures up to 500° F. and pressures up to 25,000 psi.

Figure 4A:
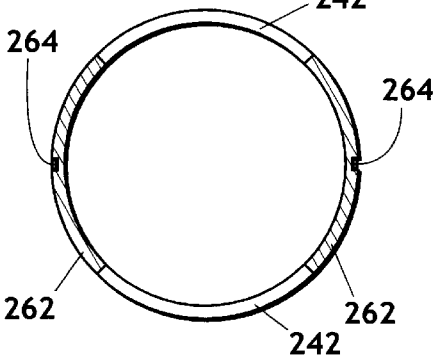
FIG. 4A is a cross-sectional illustration of the two wire embodiment of the insert taken along line 4—4 in FIG. 2.

FIG. 4A is a cross-section of the two wire embodiment of insert 200 taken along line 4—4 in FIG. 2. Inset 200 may contain only one wire 246 or may contain a plurality of wires 246. For simplicity of illustration of the invention, FIGS. 1 through 9B (excluding 4B) depict the invention with only two wires. In alternative embodiments, wire 246 can be a fiber optic in which case the two electrical connections on insert 200 would be optical connections and the fiber optic would be optically coupled to the optical connections. In another alternative embodiment, the invention could employ a mixture of fiber optics and electrical wires. In the preferred embodiment the invention incorporates three wires such that the three wires each carry the appropriate load of a three phase, 440-volt electrical system, as illustrated in FIGS. 4B and 10 through 15. However, the number and type of wires is not meant to be a limitation on the invention as those skilled in the art will be aware of how best to configure the invention with fiber optics, electrical wiring, or other connections within insert groove 244 of improved drill pipe 100.

Figure 6:
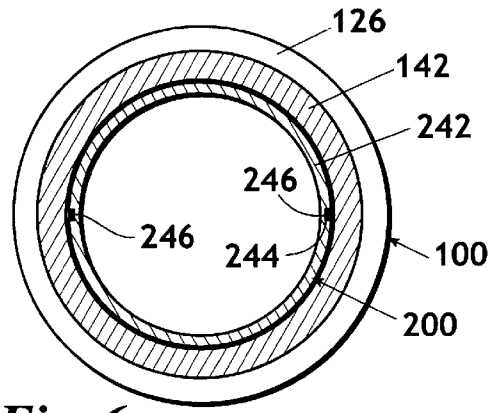
FIG. 6 is a cross-section of the two wire embodiment of the insert installed in the improved tubing taken along line 6—6 in FIG. 5.

FIG. 3 is an illustration of improved tubing 100 with insert 200 installed. Insert 200 is sized lengthwise so that when insert 200 is inserted into improved tubing 100, insert first end projection 222 is flush with first end 120 and insert second end projection 262 is the only portion of insert 200 that is projecting beyond second end 160. As seen in FIG. 6, insert 200 is circumferentially sized such that the outer diameter of insert 200 is sufficiently equal to the inside diameter of improved tubing 100. Insert groove 244 is sufficiently deep in insert body 242 so that wire 246 does not extend beyond the outer diameter of insert 200, yet is not deep enough to affect the structural integrity of insert 200. Insert 200 is coaxially positioned inside improved tubing 100 and secured in place. In the preferred embodiment, insert 200 is the same material as improved tubing 100 and is secured in place by welding. However, insert 200 can be made of any material suitable for drilling operations including various metal alloys, fiberglass, plastic PVC, polymer, or any other material as determined by those of skill in the art. Likewise, insert 200 can be secured in place by welding, glue, heat shrinking, expanding, set screws, or any other method as determined by those skilled in the art. Heat shrinking is defined as a process in which the outer pipe is heated so that the outer pipe expands, the insert is positioned inside the pipe, and the pipe is allowed to cool so that it contracts and secures the insert in place. Expanding is a process in which a tool (expander), having a slightly larger outside diameter than the inside diameter of the insert, is pulled forcibly through the insert causing the outside surface of the insert to expand and grip the inside of the improved tubing. Set screws is a process in which the improved tubing and insert are tapped and threaded and a screw is inserted through the improved tubing and insert to secure the insert in place relative to the pipe.

Figure 7:
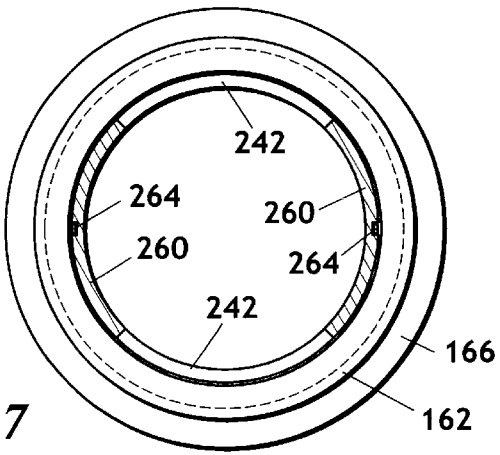
FIG. 7 is a cross-section of the two wire embodiment of the insert installed in the improved tubing taken along line 7—7 in FIG. 5.
Figure 5:
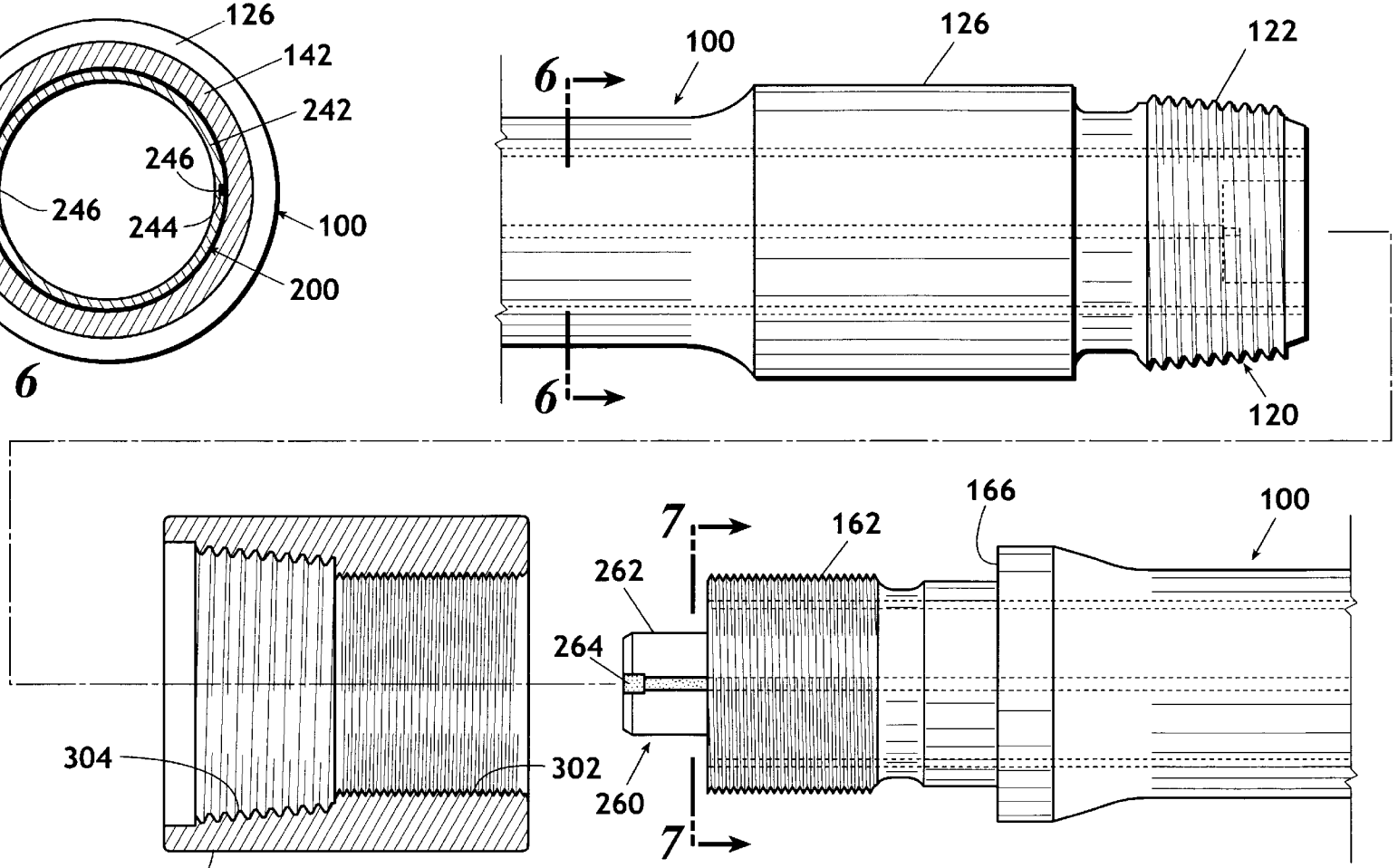
FIG. 5 is an exploded illustration of the connection between the first end of the improved drill pipe and the second end of the improved tubing.

FIG. 5 is an exploded illustration of the connection between two separate pieces of improved tubing 100 with insert 200 installed and coupler 300 positioned for installation on first end 120 and drill pipe second end 160. Coupler 300 is annular in shape and contains coupler fine threads 302 and coupler coarse threads 304. Coupler fine threads. 302 are configured for screwing engagement with drill pipe fine threads 162. Coupler coarse threads 304 are configured for screwing engagement with drill pipe coarse threads 122. The pitch of drill pipe coarse threads 122 and drill pipe fine threads 162 are different pitch so that coupler 300 can only mate up with improved tubing 100 in one orientation. Similarly, when coupler fine threads 302 and coupler coarse threads 304 engage pipe coarse threads 122 and drill pipe fine threads 162, the coarse threads and the fine threads do not interfere with the threading process of each other. As seen in FIG. 7, coupler stop flange 166 has a larger cross-sectional area than fine threads 162 and acts as a stop for coupler 300 so that coupler 300 does not go past second end 160. The outside diameter of coupler 300 is sufficiently similar to pipe wrench grip 126 so that when the user is attaching the individual pieces of improved drill pipe 100 together, a pipe wrench will fit onto both pipe wrench grip 126 and coupler 300 without undue adjustment of the pipe wrench. Coarse threads 122 and coupler coarse threads 304 are tapered so that they may be completely engaged with a minimal amount of rotations after first end 120 and second end 160 have been plugged together. Coupler 300 is also sufficiently long so that when coupler 300 is completely screwed onto second end 160 and abuts coupler stop flange 166, coupler 300 extends past insert second end projection 262. It is important that coupler 300 extend past insert second end projection 262 because improved tubing 100 will typically be stored, transported, and handled with coupler 300 installed on second end 160 and coupler 300 will protect insert second end 260 and specifically insert second end electrical connection 264 from damage.

Figure 8:
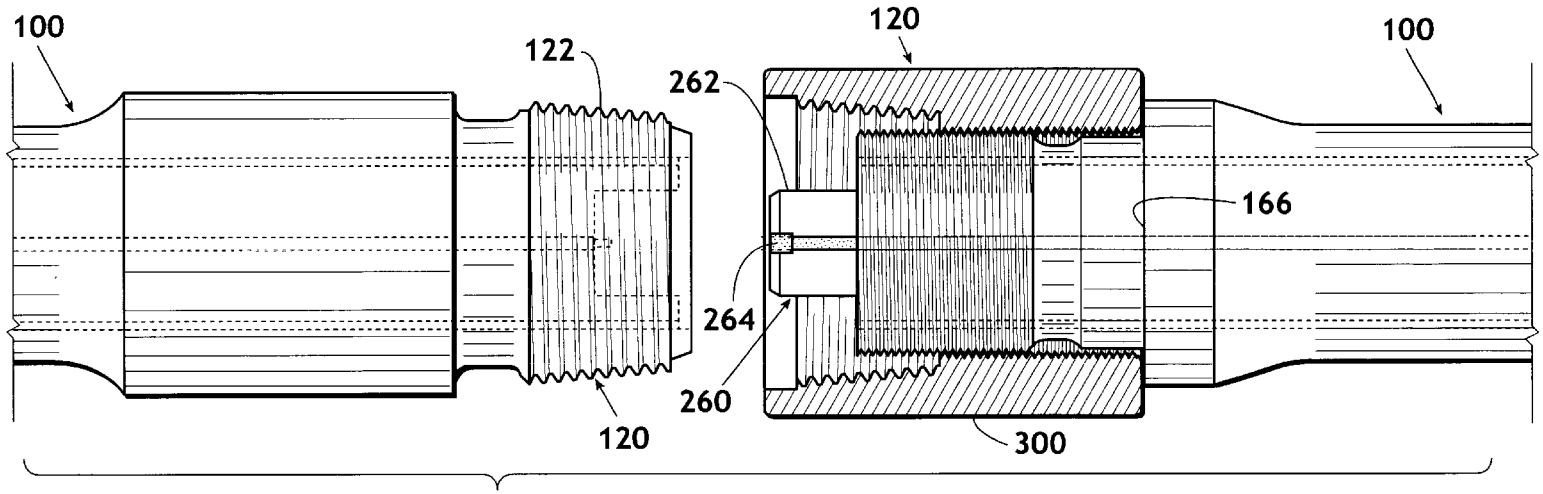
FIG. 8 is an illustration of the positioning and alignments steps for the two wire embodiment of the improved tubing.
Figure 4B:
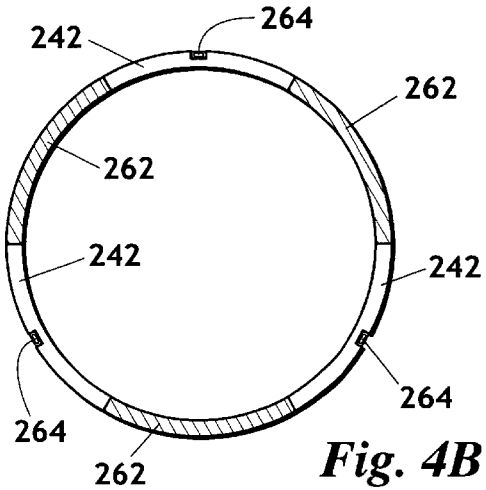
FIG. 4B is a cross-sectional illustration of the three wire embodiment of the insert similar to the two wire embodiment in FIG. 4A.

FIG. 8 is an illustration of coupler 300 installed on second end 160 just prior to connection of two pieces of improved tubing 100. FIG. 8 is representative of how improved tubing 100 will be stored, transported, and handled. In FIG. 8, coupler 300 extends past insert second end projection 262 and insert second end electrical connection 264.

Figure 9A:
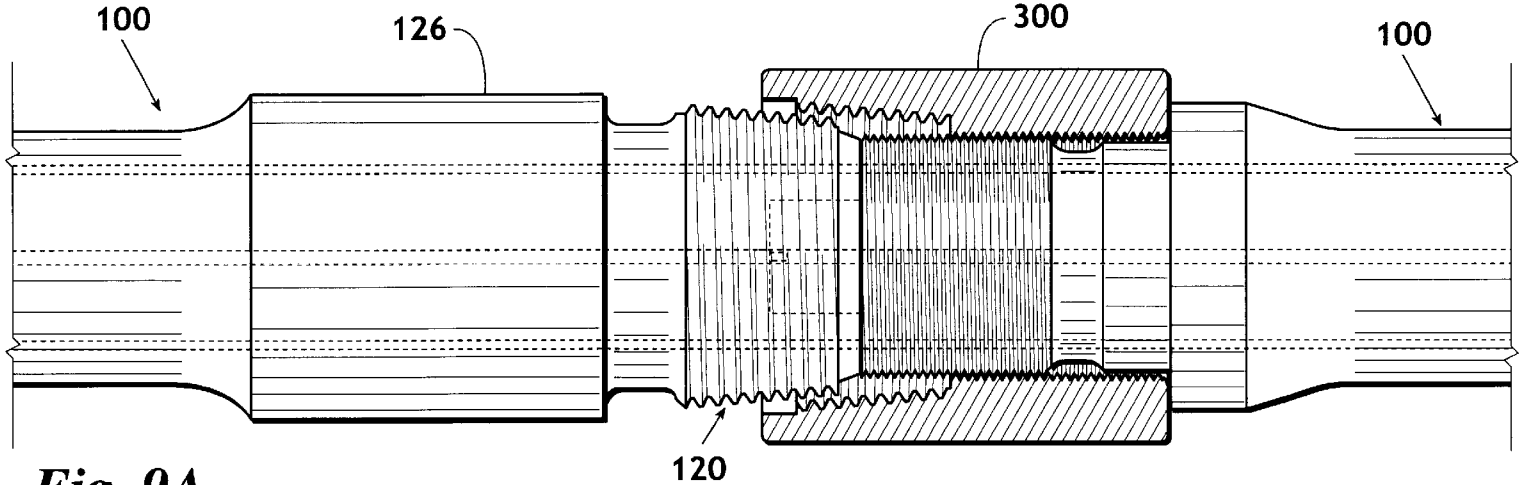
FIG. 9A is an illustration of the plugging step for the two wire embodiment of the improved tubing.
Figure 9B:
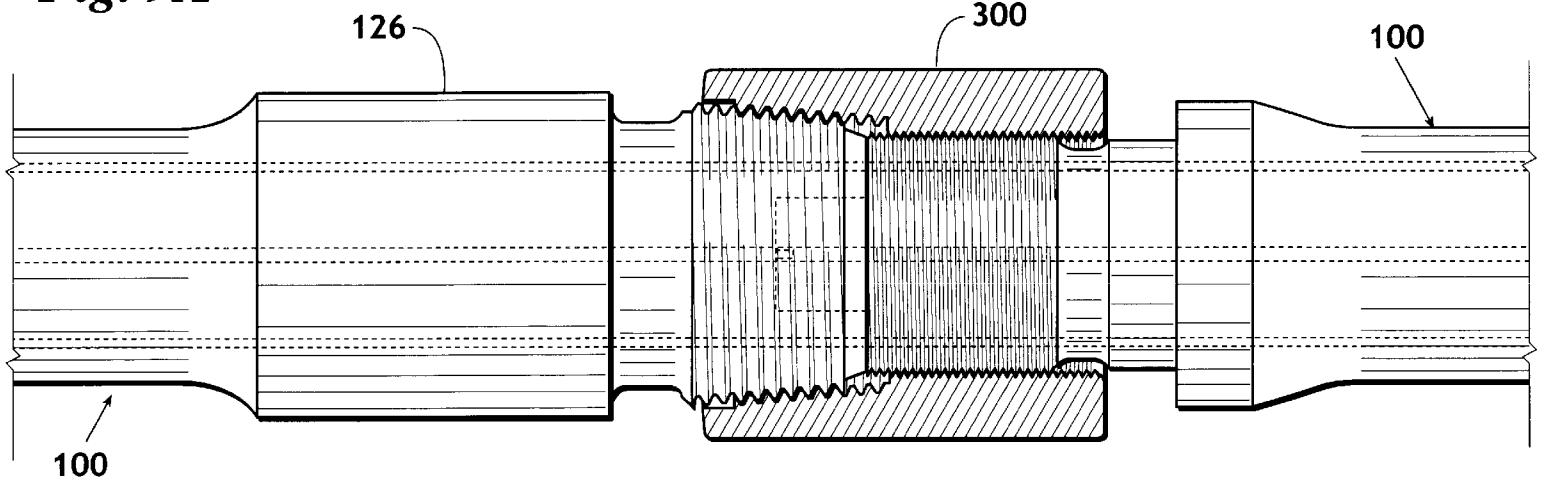
FIG. 9B is an illustration of the securing step for the two wire embodiment of the improved tubing.

FIGS. 8, 9A, and 9B illustrate the process of attaching two sections of improved tubing 100 together. In attaching the two sections of improved tubing 100 together, as far as the scope of this invention is concerned, it does not matter whether the second end 160 of one section of improved tubing 100 is above the first end 120 of the other section of improved tubing 100 or vice-versa. The improved tubing 100 may also be connected in the horizontal. However, the preferred embodiment and industry standard is to place the second end 160 above the first end 120. The attachment process comprises four steps: positioning, aligning, plugging, and securing. First, in the positioning step the two sections of improved tubing 100 are positioned over one another with a second end 160 of one improved tubing 100 facing the first end 120 of the other improved tubing 100. As seen in FIG. 8, the aligning step consists of rotating one or both sections of improved tubing 100 such that the insert second end projection 262 in one section of improved tubing 100 will properly mate with the insert first end projection 222 in the other section of improved tubing 100.

When the two sections of improved tubing 100 are properly aligned, the two sections of improved tubing 100 may be plugged together. FIG. 9A is an illustration of the plugging step in which two sections of improved tubing 100 are plugged together. In the plugging step, the second end 160 of one section of improved tubing 100 is lowered onto the first end 120 of the other section of improved tubing 100 until the two sections of improved tubing 100 contact each other and/or the two inserts 200 fully mate with each other. To properly mate, insert second end projections 262 will fill the depression between insert first end projections 222 and insert first end projections 222 will fill the depression between insert second end projections 262. When insert first end projection 222 and insert second end projection 262 properly mate, insert first end electrical connection 224 and insert second end electrical connection 264 will electrically couple and provide an electrical connection which will tolerate the harsh environment of the well bore. After the two improved tubing 100 are plugged together, they are secured by screwing coupler 300 onto first end 120.

FIG. 9B is an illustration of two sections of improved tubing 100 secured together by coupler 300. Coupler 300 is secured to first end 120 by pipe wrenches (not shown) which grip coupler 300 and pipe wrench grip 126 and torque coupler 300 until coupler 300 is firmly screwed onto drill pipe first end 120. The two sections of improved tubings 100 may then be used in the production process.

Figure 10:
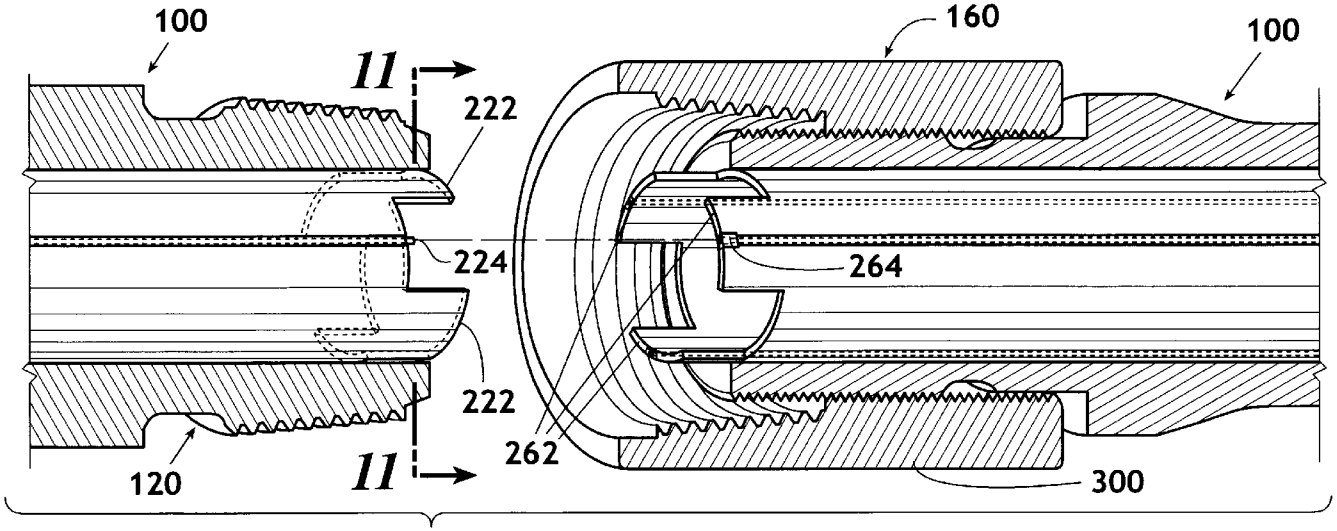
FIG. 10 is an illustration of the positioning and alignment step for the three wire embodiment of the improved tubing. The dashed line indicates the alignment of the wire connectors in the three wire insert embodiment.
Figure 12:
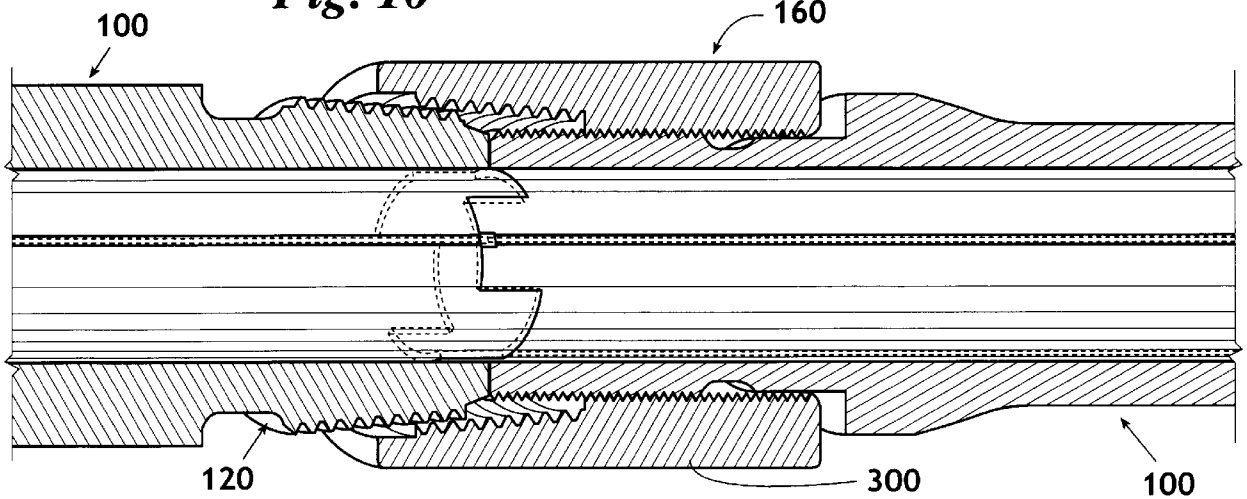
FIG. 12 is an illustration of the plugging step for the three wire embodiment of the improved tubing.
Figure 13:
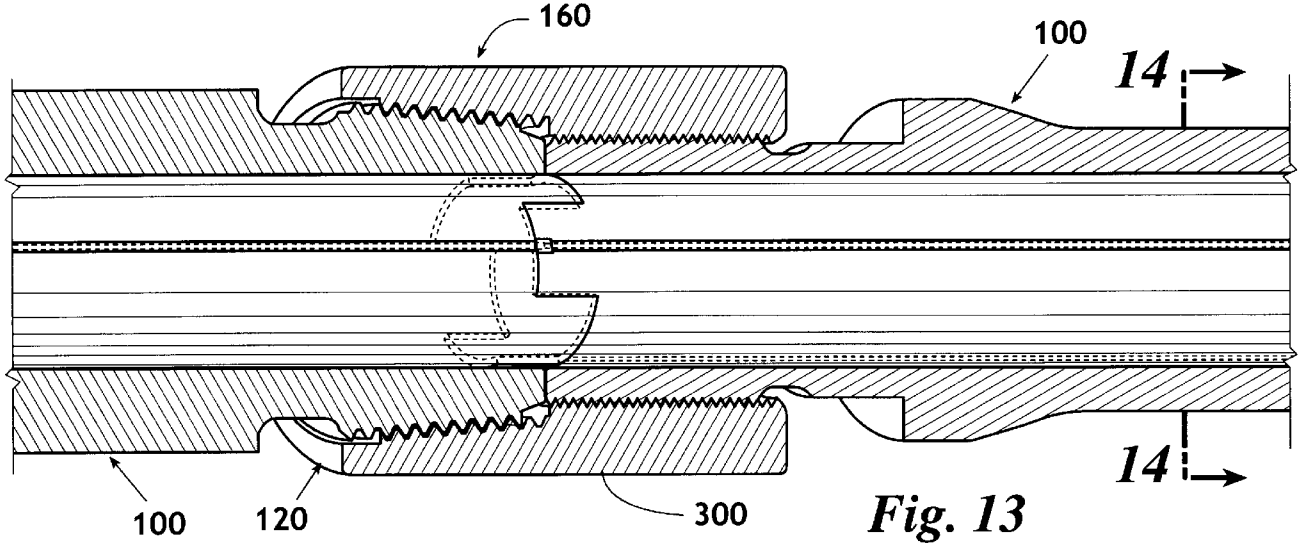
FIG. 13 is an illustration of the securing step for the three wire embodiment of the improved tubing.
Figure 11:
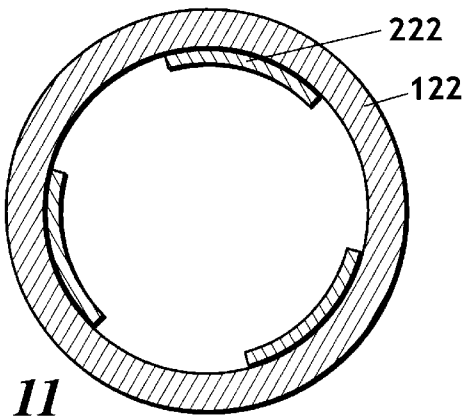
FIG. 11 is a cross-sectional illustration of the three wire embodiment of the insert taken along line 11—11 in FIG. 10.

FIGS. 10 through 14 illustrate a three wire embodiment. The manufacture of the three wire improved drill pipe is similar to the manufacture of the two wire improved tubing. Likewise, the assembly of a plurality of three wire improved tubing is similar to the assembly of a plurality of two wire improved tubing. FIG. 10 is an illustration of the alignment step for a three wire embodiment of the insert in which coupler 300 is installed on second end 160. The dashed line in FIG. 10 indicates the alignment of insert first end electrical connection 224 and insert second end electrical connection 264. When the two electrical connectors are properly aligned, insert first end projection 222 and insert second end projection 262 are also properly aligned. FIG. 11 is a cross-sectional illustration of the three wire embodiment of insert 200 and improved tubing 100 taken along line 11—11 in FIG. 10. FIG. 12 is an illustration of the plugging step for the three wire embodiment of insert 200 taken along line 11—11 in FIG. 10. FIG. 13 is an illustration of the securing step of two pieces of improved tubing 100 with the three wire embodiment of insert 200 and the coupler disengaged from the first end of the tubing.

Figure 14:
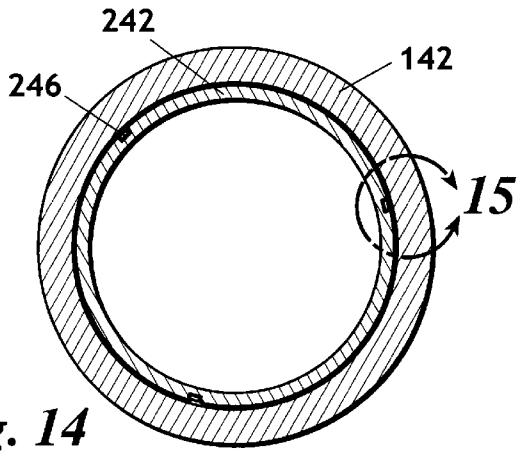
FIG. 14 is a cross-sectional illustration of the three wire embodiment of the insert taken along line 14—14 in FIG. 13.
Figure 15:
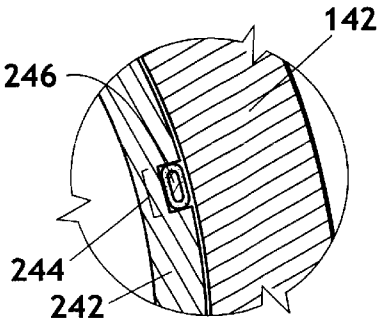
FIG. 15 is a detail view of the geometry between the insert, the wire, and the improved tubing around the area indicated by circle 15 in FIG. 14.

FIG. 14 is a cross-section of the three wire embodiment of the insert taken along line 14—14 in FIG. 13. Insert 200 in the three wire embodiment is similar to insert 200 in the two wire embodiment in that the inside diameter of pipe 142 is substantially the same as the outside diameter of inset body 242. FIG. 15 is a detail view of the geometry between insert 200, wire 246, and improved tubing 100 around the area indicated by circle 15 in FIG. 14. FIG. 15 illustrates the point that insert groove 244 is cut into insert body 242 so that wire 246 does not project above the outer surface of insert body 242.

Figure 16:
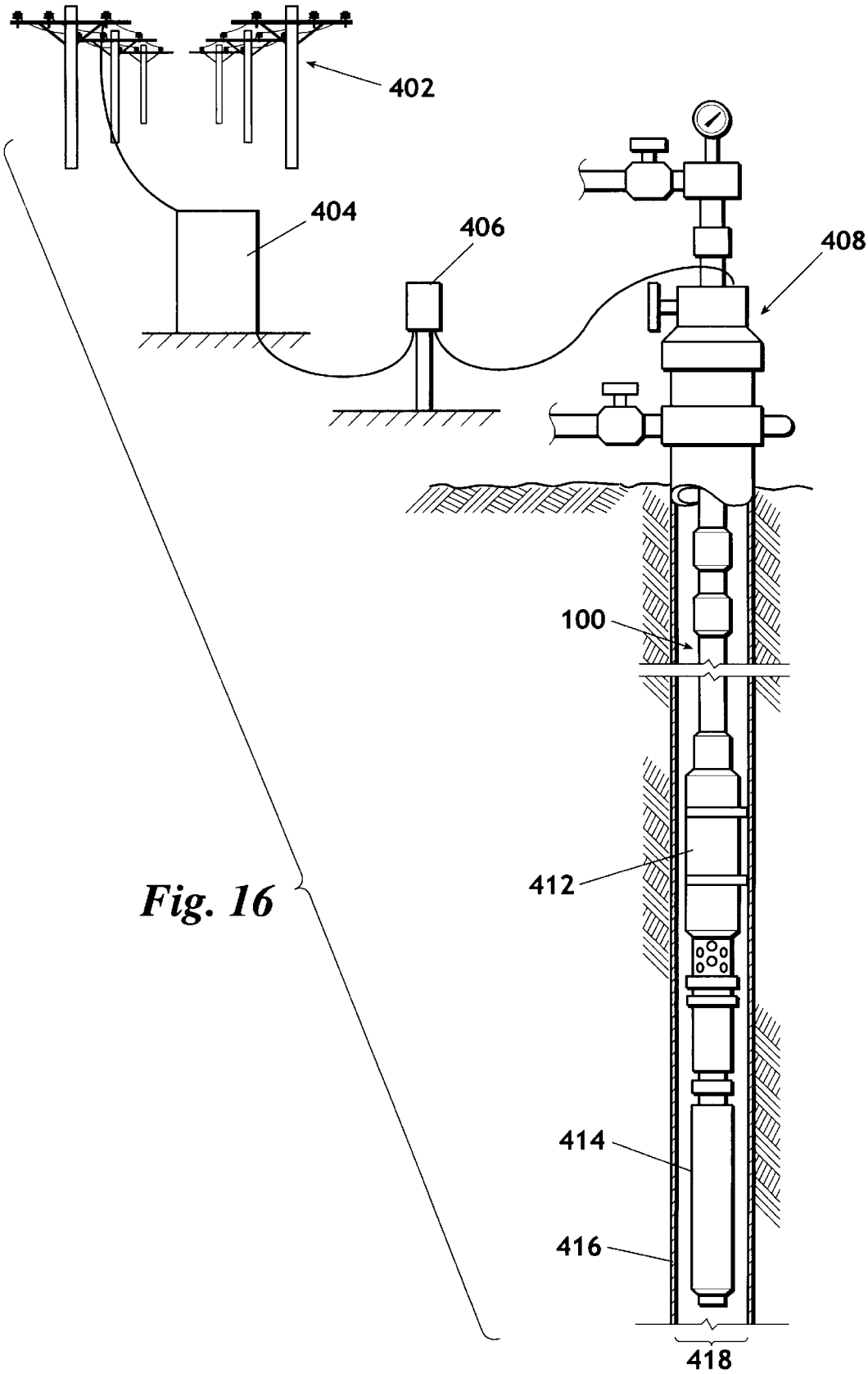
FIG. 16 is an illustration of a submerged pump in a production situation.

FIG. 16 is an illustration of a submerged pump in a production situation. FIG. 16 shows multiple pieces of improved tubing 100 with the inserts installed (not shown). Power comes from an external source 402 and is stepped down in transformer 404, is routed through vent box 406, and goes to wellhead 408. Power is transmitted down tubing pump 412 and or motor 414. Well bore 418 is typically cased with casing 416.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

What is claimed is:

1. An apparatus for providing a tubing with electrical transmission capability comprising:

an improved tubing having an inside and an outside;

a cylindrical insert engaged with the inside of the improved tubing and having a proximate end and a distal end;

at least one groove disposed lengthwise in said cylindrical insert; and at least one wire positioned within said groove.

2. The apparatus of claim 1 further comprising a pair of connectors coupled to said at least one wire at the proximate end and the distal end of said cylindrical insert.

3. The apparatus of claim 1 wherein the groove is on the outside of said insert.

4. The apparatus of claim 1 further comprising at least one projection on the proximate end of said cylindrical insert.

5. The apparatus of claim 4 further comprising at least one depression on the distal end of said cylindrical insert.

6. The apparatus of claim 5 wherein said at least one projection mates up with said at least one depression when a plurality of said cylindrical inserts are aligned along a common central axis.

7. The apparatus of claim 6 further comprising a pair of connectors coupled to said at least one wire at the proximate end of said cylindrical insert and the distal end of said cylindrical insert.

8. The apparatus of claim 7 wherein said pair of connectors are coupled with similar connectors on similar improved tubing when said at least one projection mates up with said at least one depression.

9. The apparatus of claim 7 wherein said connectors are electrical connectors, and said at least one wire is an electrical wire.

10. The apparatus of claim 7 wherein said connectors are optical connectors, and said at least one wire is a fiber optic.

11. An apparatus for transmitting power to a well bore comprising:

an improved tubing having a proximate end and a distal end;

a cylindrical insert sized for engagement within said improved tubing and having a proximate end and a distal end;

at least one groove lengthwise disposed in said cylindrical insert;

at least one wire positioned within said groove; and wherein said cylindrical insert is coaxially disposed within said improved tubing.

12. The apparatus of claim 11 further comprising a coupler screwed onto the distal end of said improved tubing.

13. The apparatus of claim 12 further comprising a coupler stop flange disposed at the distal end of said improved tubing.

14. The apparatus of claim 12 wherein said proximate end of said improved tubing and said coupler have coarse threads.

15. The apparatus of claim 14 wherein said coarse threads are tapered threads.

16. The apparatus of claim 11 further comprising at least one depression on the distal end of said cylindrical insert.

17. The apparatus of claim 16 wherein a projection mates up with said at least one depression when a plurality of said cylindrical inserts are aligned along a common central axis.

18. The apparatus of claim 11 further comprising a pair of connectors coupled to said at least one wire at the proximate end of said cylindrical insert and the distal end of said cylindrical insert.

19. The apparatus of claim 18 wherein said pair of connectors are coupled with similar connectors on similar improved tubing when a projection mates up with a depression.

20. The apparatus of claim 19 wherein said connectors are electrical connectors and said at least one wire is an electrical wire.

21. The apparatus of claim 19 wherein said connectors are optical connectors, and said at least one wire is a fiber optic.

22. An apparatus for producing fluids from a subterranean rock formation comprising:

a wellhead containing a power transmission device;

at least one improved tubing having a proximate end and a distal end;

a cylindrical insert coaxially disposed within each of said improved tubings;

at least one groove lengthwise disposed in said cylindrical insert;

at least one wire positioned within said groove; and wherein said power transmission device transmits power from the wellhead to the bottom of a well bore via the at least one wire.

23. The apparatus of claim 22 further comprising a coupler screwed onto the distal end of said improved tubing.

24. The apparatus of claim 23 further comprising a coupler stop flange disposed at the distal end of said improved tubing.

25. The apparatus of claim 23 wherein said proximate end of said improved tubing and said coupler have coarse threads.

26. The apparatus of claim 25 wherein said coarse threads are tapered threads.

27. The apparatus of claim 22 further comprising at least one depression on the distal end of said cylindrical insert.

28. The apparatus of claim 27 wherein a projection mates up with said at least one depression when a plurality of said cylindrical inserts are aligned along a common central axis.

29. The apparatus of claim 22 further comprising a pair of connectors coupled to said at least one wire at the proximate end of said cylindrical insert and the distal end of said cylindrical insert.

30. The apparatus of claim 29 wherein said pair of connectors are coupled with similar connectors on similar improved tubing when a projection mates up with a depression.

31. The apparatus of claim 30 wherein said connectors are electrical connectors, and said at least one wire is an electrical wire.

32. The apparatus of claim 30 wherein said connectors are optical connectors, and said at last one wire is a fiber optic.

33. A method for attaching a first improved tubing and a second improved tubing comprising:

positioning said first improved tubing coaxially with said second improved tubing;

aligning said first improved tubing with said second improved tubing;

plugging said first improved tubing into said second improved tubing so that a first connector in said first improved tubing couples with a second connector in said second improved tubing allowing transmission of a signal between said first improved tubing and said second improved tubing; and securing said first improved tubing to said second improved tubing.

34. The method of claim 33 wherein said second improved tubing is vertically above said first improved tubing.

35. The method of claim 33 wherein an insert projection is used to align said first improved tubing and said second improved tubing.

36. The method of claim 33 wherein said first connector and said second connector are electrical connectors and said signal is an electrical signal.

37. The method of claim 33 wherein said first connector and said connector are optical connectors and said signal is an optical signal.

38. The method of claim 33 wherein a coupler is used to secure said first improved tubing to said second improved tubing.

39. A method of manufacturing an improved tubing comprising:

cutting at least one groove in an insert;

embedding at least one wire in the groove of said insert; and installing said insert in said improved tubing.

40. The method of claim 39 further comprising screwing a coupler onto said improved tubing.

41. The method of claim 39 further comprising securing said insert in said improved tubing.

42. The method of claim 41 wherein said securing is done by welding.

43. The method of claim 41 wherein said securing is done by gluing.

44. The method of claim 41 wherein said securing is done by heat shrinking.

45. The method of claim 41 wherein said securing is done by set screws.

46. The method of claim 41 wherein said securing is done by expanding.

47. The method of claim 39 further comprising attaching a pair of connectors to said wire.

48. The method of claim 47 wherein said connectors are electrical connectors.

49. The method of claim 47 wherein said connectors are optical connectors.

* * * * *